United States Patent [19]

Ray et al.

[11] 4,359,352

[45] Nov. 16, 1982

[54] NICKEL BASE SUPERALLOYS WHICH CONTAIN BORON AND HAVE BEEN PROCESSED BY A RAPID SOLIDIFICATION PROCESS

[75] Inventors: Ranjan Ray, Waltham, Mass.; Donald E. Polk, Washington, D.C.; Bill C. Giessen, Cambridge, Mass.

[73] Assignee: Marko Materials, Inc., Watertown, Mass.

[21] Appl. No.: 95,382

[22] Filed: Nov. 19, 1979

[51] Int. Cl.[3] ..... C22C 30/00; C22C 19/05

[52] U.S. Cl. ..... 148/31; 75/0.5 R; 75/123 B; 75/124; 75/128 F; 148/409; 148/410; 420/443

[58] Field of Search ..... 75/170, 171, 122, 123 B, 75/124, 128 F, 134 F, 0.5 R; 148/32, 32.5, 31

[56] References Cited

U.S. PATENT DOCUMENTS

| | | | |
|---|---|---|---|
| 3,856,513 | 12/1974 | Chen et al. | 75/171 |
| 3,871,836 | 3/1975 | Polk et al. | 75/170 |
| 4,207,098 | 6/1980 | Shaw | 75/171 |

*Primary Examiner*—R. Dean

*Attorney, Agent, or Firm*—Morse, Altman, Oates & Dacey

[57] ABSTRACT

Nickel and iron-nickel base alloys are described together with a rapid solidification process used in the preparation thereof to provide materials useful in the fabrication of parts subject to high temperature operating conditions. The alloys include commercial nickel base superalloys to which a specified amount of boron is added.

22 Claims, No Drawings

NICKEL BASE SUPERALLOYS WHICH CONTAIN BORON AND HAVE BEEN PROCESSED BY A RAPID SOLIDIFICATION PROCESS

BACKGROUND OF THE INVENTION

1. Field of the Invention

This invention is concerned with (a) metal alloys which are useful, e.g., to construct the high temperature components of gas turbines for aerospace and industrial needs and which have compositions obtained by adding boron to alloys similar to commercial nickel base superalloys, and, (b) the preparation of these materials using a rapid solidification process and the consolidation of the rapidly solidified ribbons, powders, etc. into bulk parts which are then heat treated to uniform microstructure and desirable high temperature properties.

2. Description of the Prior Art

Nickel base superalloys have been developed for applications requiring high strength at elevated (i.e., above ~1000° F. or 540° C.) temperatures, in particular, for gas turbine components (e.g., disks, blades and vanes). In "intermediate" temperature applications, turbine disks are subjected to operating temperatures up to 1400° F. (760° C.) and radial and/or cyclic stresses of the order of 70,000 psi. (Operating temperatures above 1400° F. are labelled as "high" temperature applications). Disk materials require high tensile strength as well as good creep and fatigue strength at such temperatures. The replacement of a current material with one having higher strengths (i.e., tensile, creep and fatigue) would permit the use of thinner disks, thus saving weight and improving performance.

Typical nickel base superalloys consist of an austenitic (fcc) phase matrix, the $\gamma$ phase (rich in nickel as well as containing chromium, tungsten, molybdenum and/or cobalt), which contains a large volume fraction (20–60%) of a hardening coherent precipitate phase, $\gamma'$, which is $Ni_3(Al,Ti)$. The optional additional alloying elements, e.g., iron, columbium, tantalum, vanadium, zirconium, boron, carbon, etc., partition to some degree between $\gamma$ and $\gamma'$.

One traditional approach to increase strength has been to increase the amount of the elements such as Al and Ti so as to increase the volume fraction of the hardening phase, $\gamma'$. However, highly alloyed superalloys, when conventionally cast as large ingots, are prone to deleterious compositional segregation (micro and macro), especially from the formation of an intermetallic phase when a eutectic liquid is present during solidification, resulting in inhomogeneous structures, poor hot workability and nonuniform properties.

In recent years, powder metallurgy (P/M) has become increasingly attractive as a processing technique for advanced, highly complex superalloys. P/M has been used to improve the economics and properties of alloys compared to those produced by other methods, as well as to develop alloy structures and properties that can not be obtained by more conventional processing techniques (see "Powder Metallurgy" by G. I. Friedman and G. S. Ansell in *The Superalloys*, C. T. Sims and W. C. Hagel, Eds., John Wiley and Sons, N.Y., 1972, pp. 427–449). The nickel base superalloy IN-100 is used for turbine disks in the Pratt & Whitney F-100 engines and is usable in large forgings only when it is produced from inert gas atomized powder. This is because the alloy contains large additions of alloying elements that result in undesirable chemical segregation when cast into ingots large enough to produce the subject forgings. In addition to improved hot workability, other potential beneficial effects of the powder technique are high tensile and fatigue strength and high toughness as a consequence of fine grain size in the powder metallurgical superalloys, at the disk's operating temperature in the "intermediate" temperature range of up to 1400° F. In the "high" temperature range (>1400° F.) for turbine blade and vane applications, fine grained superalloys are unsuitable because of low creep strength resulting from increased grain boundary creep.

Metal powders when produced directly from the melt by conventional inert gas atomization techniques are usually cooled three to four orders of magnitude faster than an ingot, although still several orders of magnitude slower than the rapid solidification processing (RSP) methods known in the state of the art.

Metallic alloys can be fabricated by economical RSP methods as ribbons, filaments, flakes and powders by melt spinning, melt extraction, forced convective cooling (by helium gas) of atomized droplets, and the like (see: H. A. Davies, Rapidly Quenched Metals III, B. Cantor, Ed., The Metals Society, London, Volume 1, 1978, p. 1 and M/R. Glickstein, R. J. Patterson; and N. E. Shockey, Proceedings, Int. Conference on Rapid Solidification Processing, Reston, Va., R. Mehrabian, B. H. Kear and M. Cohen, Eds., Claitor's Publishing Division Baton Rouge, La., 1978, p. 46). Metallic glasses, microcrystalline alloys, ultrafine grained alloys with a uniform dispersion of fine particles and alloys with highly refined microstructures, including in many cases materials having complete chemical homogeneity, are some of the products that can be made by the RSP techniques. Ultrafine grained RSP powders have an added advantage in that these powders are generally suitable for superplastic deformation at sufficiently high temperatures. Therefore, a low energy of deformation is required for hot forging or hot extrusion at high ratio to achieve, (a) complete interparticle bonding, (b) breakdown of cast dendritic structure, and, (c) recrystallization of a uniform grain structure. High product integrity is usually achievable with RSP powders.

RSP superalloy powders produced by the helium gas, forced convective quenching of molten droplets are known to have variable particle sizes with a significant fraction ranging between 10 to 100 microns. However, particles with different sizes undergo different cooling rates. In the above particle size range, the cooling rate varies between $\sim 4\times10^4$ to $8\times10^5$ °C/sec, and the yield of powder under 100 micron particle size is only ~60% of the total initial alloy weight (see M. R. Glickstein, R. J. Patterson and N. E. Shockey, Proceedings, Int. Conference on Rapid Solidification Processing, Reston, Va., Nov. 1977). Frequently, the consolidated recrystallized alloys show significant nonuniformity of grain size due to the prior wide range of dendritic spacings present in the RSP powder mixes as a result of variable quench rates in the above-stated process. Furthermore, the fine scale grain structure desirable for "intermediate" temperature turbine disk applications can not be easily retained after hot consolidation or the subsequent high temperature heat treatments necessary to develop desirable age-hardened microstructure. On the contrary, abnormal grain growth is observed in many alloys consolidated from RSP superalloy powders and subsequently heat treated above the $\gamma'$ solvus temperature.

These coarse-grained structures are more desirable for blade applications at "high" temperatures.

Therefore, there is a need for an improved method of preparing RSP superalloy powder at uniform cooling rates with a high yield (>90%) of particles under 100 microns in size which are suitable for subsequent P/M consolidation into fully dense parts. Most importantly, the consolidated products should be capable or retaining a uniform dispersion of phases and a fine grain structure after complete heat treatment so as to be suitable for high strength disk application.

SUMMARY OF THE INVENTION

This invention features a class of nickel base alloys which have properties which make them especially useful as material used in the fabrication of parts subject to operating at "intermediate" temperature (up to 1400° F.) such as gas turbine components, e.g., disks, when production of these alloys includes a rapid solidification process. These alloys differ from presently available commercial nickel base superalloys in that they contain 0.4 to 1.7 wt% boron; they can be described as $(N.S.)_{bal}B_{0.4-1.7}$ where N.S. represents a nickel base alloy typical of commercial $\gamma/\gamma'$ type nickel base superalloys.

Most generally, N.S. is given by the formula $N.S.=Ni_{bal}M_aM'_bT_c$ (Formula 1) where M is one or more of Ti, Al, Cb and Ta; M' is one or more of Cr, Co, Fe W and Mo; T is one or more of the elements generally appearing in smaller amounts, specifically B and C as well as elements such as Hf, Zr, V, Mn, Si, Mg, etc. where $7 \leqq a \leqq 20$, $8 \leqq b \leqq 43$ and $0.1 \leqq c \leqq 4$, and where $a+b+c<50$; the subscripts a, b and c are given in atomic percent since this best illustrates the role of the different components in the alloy (in most other parts of this description, the subscripts are in weight percent), and the Mo and W content combined is in the range of 0 to 15 at%. In this alloy, the primary role of the element M is to form the $\gamma'$ strengthening phase, $Ni_3M$. Thus, the value of "a" controls the relative amount of $\gamma'$ which is present. The elements M' are present primarily as solute replacements for Ni in the $\gamma$ phase and produce solid solution hardening, with molybdenum, tungsten and chromium being the most effective. Each of the elements included in the group T are present in low amounts and in some cases tend to segregate to the grain boundaries; the most important are C (typically present at ~0.5 to 1 at%) which forms strengthening carbides with the more refractory metals, and B (typically present at ~0.1 at%) and Zr which are believed to segregate to grain boundaries and inhibit grain boundary cracking.

The generalized composition for typical present commercial nickel base superalloys (where we now use the more conventional weight percent subscripts) is: $(N.S.=Ni_{bal}Cr_{6-20}Ti_{0-6}Al_{1-8}Cb_{0-4}Ta_{0-10}Mo_{0-13}W_{0-13}Co_{0-25}Fe_{0-20}B_{0-0.3}C_{0.04-0.35}$ (Hf, Zr, V, Mn, Si, Mg)$_{0-4}$. For example, IN-100 has the composition $Ni_{bal}Cr_{10}Co_{15}Mo_3V_1Ti_{4.7}Al_{5.5}B_{0.014}C_{0.18}Zr_{0.06}$; Astroloy has the composition $Ni_{bal}Cr_{15}Co_{15}Mo_{5.25}Ti_{3.5}Al_{4.4}B_{0.03}C_{0.06}$; Rene 95 has the composition $Ni_{bal}Cr_{14}Co_8Mo_{3.5}W_{3.5}Ti_{2.5}Al_{3.5}Cb_{3.5}B_{0.01}C_{0.15}Zr_{0.05}$: Udimet 700 has the composition $Ni_{bal}Cr_{15}Co_{18.5}Mo_5Ti_{3.5}Al_{4.4}B_{0.025}C_{0.07}$; Waspaloy has the composition $Ni_{bal}Cr_{19.5}Co_{13.5}Mo_{4.3}Ti_3Al_{1.4}Fe_2B_{0.006}C_{0.07}Zr_{0.09}Cu_{0.1}$; and B1900 has the composition $Ni_{bal}Cr_8Mo_6Ti_1Al_6Fe_{0.35}Ta_{4.3}Co_{10}C_{0.1}B_{0.015}Zr_{0.08}$.

Rapid solidification processing (RSP) (i.e., solidification using processes which produce cooling rates of the order of $10^5$–$10^7$ °C/sec) of the $(N.S.)_{bal}B_{0.4-1.7}$ produces a solidified alloy having a crystalline metastable structure which is chemically homogeneous and which, after heating so as to transform the microstructure to a more stable state, has a microstructure which is more uniform and has a smaller grain size than that found in currently available materials. This transformed material can be superior to presently available conventional nickel base superalloys.

The inclusion of boron in the alloy has several advantages. It enhances the supercooling of the liquid which is achievable and leads to the easy formation of a chemically homogeneous, metastable crystalline product when a RSP process is utilized. The fine boride particles formed during the heat treatments strengthen the metal. These borides do not dissolve in the solid state matrix at elevated operating temperatures, giving enhanced elevated temperature strength. The fine borides act to restrain, by grain boundary pinning, coarsening of the matrix grains during the hot consolidation operation and the subsequent solution treatment of the $\gamma'$ ($Ni_3Al$) phase at high temperature above the Y' solvus which is necessary to reprecipitate fine $\gamma'$ on cooling. Finally, the inclusion of boron makes it possible to obtain a good yield of uniform material from melt spinning, an especially economical RSP process. The as-quenched melt spun ribbons are brittle and can readily be ground to a powder, a form which is especially useful for subsequent consolidation to the transformed (ductile) final product.

In commercial superalloys which are conventionally processed, boron is generally present at levels below 300 ppm (i.e., below 0.03 wt%) as a desirable ingredient. At these low levels B is believed to segregate to the grain boundaries where it retards high temperature (i.e., grain boundary) creep and grain boundary cracking. When boron is present in the nickel base superalloy in the amount within the scope of the present invention and the alloys are conventionally cast, the alloy will be undesirable due to the presence of massive brittle eutectic borides at the primary grain boundaries.

Similarly, the present procedures can be applied to the iron-nickel base superalloys. These are described by a general formula similar to Formula 1, but in this case the Fe content is generally in the range of ~20 to 65 at% with the Ni content having been correspondingly decreased by being further substituted for by the iron.

DETAILED DESCRIPTION OF THE PREFERRED EMBODIMENTS

In accordance with the invention, commercial nickel base superalloys, in particular those which are primarily used in the $\gamma'$ precipitation hardened condition, are alloyed with 0.4 to 1.7 wt% boron. The preferred boron content is between 0.8 to 1.25 wt%. These modified nickel base superalloys are rapidly solidified from the melt by known standard methods, most readily by melt spinning, which consists of casting a molten jet onto a rapidly moving surface (~6000 ft/min) of a chill substrate made of materials of good thermal conductivity, such as copper, precipitation hardened copper-beryllium alloy, nickel and nickel base superalloys, etc.

The rapidly solidified alloy consists of nearly 100% of a single, homogeneous, nickel rich solid solution phase with a f.c.c. crystal structure. This Ni rich phase ($\gamma$) is metastable and highly supersaturated since it contains all of the alloying elements (most significantly, boron) plus incidental impurities as a solid solution. These rapidly solidified alloys are brittle, i.e., they fracture when bent to a radius of curvature less than 50–100 times their thickness. The brittle ribbons obtained from melt spinning can be mechanically comminuted to powders of desirable size ranges, preferably below 100 mesh, which are in some cases especially convenient for subsequent consolidation. Standard equipment (such as a hammer mill attritter, fluid energy mill and the like) can be used for pulverization of the ribbons into powder.

The alloys, most conveniently in the form of powders, are hot consolidated to fully dense structural parts by suitable known metallurgical techniques such as hot uniaxial pressing, hot isostatic pressing, hot forging, hot extrusion, hot rolling and the like. During consolidation, the highly supersaturated $\gamma$ solid solution phase decomposes into solute lean $\gamma$ and a fine dispersion of intermetallic $\gamma'$, borides (MB, $M_2B$, $M_3B_2$ and the like) and carbides (MC, $M_6C$, $M_{23}C_7$ and the like) and mixtures thereof. The particle sizes of the borides and carbides range between 0.1 and 1 micron, preferably below 0.3 micron. During consolidation at or above the $\gamma'$ solvus, considerable coarsening and substantial dissolution of $\gamma'$ will take place; however, a stable dispersion of hard boride particles remaining in the matrix at the consolidation temperature (typically 10–20 volume %) will prevent recrystallization and/or substantial coarsening of the primary $\gamma$ grains. Subsequent to consolidation, a dispersion of fine $\gamma'$ particles in the matrix is developed in accordance with solution heat treatment plus ageing treatment as commonly practiced for conventional nickel base, $\gamma'$ hardened superalloys. If deemed necessary, prior to or during the formation of the above stated $\gamma'$ morphology, a slight grain coarsening can be obtained by suitable heat treatment to obtain the best "trade off" between tensile strength and creep strength.

It is noted that rapid solidification processing and subsequent consolidation of these alloys can be carried out in many alternative ways so as to achieve the same final result. For example, RSP powders can be made directly from the melt using one of the RSP powder processes discussed in the background section. Alternatively, the melt-spun ribbons, either as formed or after only partial fragmentation, could be consolidated without first converting them to a powder.

The alloys made in accordance with the present invention have a microstructure which is much more homogeneous and on a finer scale than that hitherto achieved by conventional casting processes.

The above-described boron-modified alloys are preferred because commercial nickel base superalloys produced by the conventional ingot-casting-hot-working technique have non-uniform coarse grain structure and segregated phases. Complex, highly alloyed superalloys (for turbine disk application) fabricated by consolidation of inert gas atomized powders possess improved chemical homogeneity and finer microstructure. However, the present alloys are superior still to the conventional superalloys made from standard atomized powders.

Boron plays a critical role in determining the "processability" of the alloys using a rapid solidification process, e.g., melt spinning, and the subsequent bulk consolidation characteristics, structure and properties of the consolidated alloys of the present invention, as disclosed below.

Several commercial nickel base $\gamma/\gamma'$ superalloys such as IN-100, MAR-M200, B1900, Rene 80, Waspaloy, IN-738, MAR-M421 and Inconel 718 (for detailed compositions, see *Source Book on Materials Selection,* Volume 2, A.S.M. 1977, pp. 74–75) were melt spun into irregularly shaped, rapidly quenched ribbons using a rotating Cu-Be cylinder (~12" diameter) rotating with a surface speed of ~5000 ft/min. The quenched ribbons were found to be fully ductile to 180° bending. Such ductile ribbons are difficult to comminute into powder.

In comparison, when boron was added to the above superalloys, significant improvement in the ribbon fabricability by melt spinning was noticed. The flow characteristics where the jet meets the wheel were improved so as to produce a stable puddle. Thus, the modified nickel superalloys can readily be rapidly solidified as continuous ribbons of good quality having uniform thickness, which indicates uniform quenching of the product throughout. Addition of boron at levels greater than ~0.4 wt% to the superalloys was found to be critical to the processability of the alloys using melt spinning. Below ~0.4 wt% boron, the alloys were cast as ductile ribbons having non-uniform cross-sections; the melt did not wet the substrate well and the ribbons often left the wheel red hot after a short contact (less than ½ inch) with the substrate. Above ~0.4 wt% boron, the melt was found to wet the substrate well and formed uniform, good quality ribbons which were quenched to a much lower temperature while in contact with the wheel. The ribbons were, furthermore, found to be brittle, i.e., they showed very low bend ductility. The ribbons would fracture when bent to a radius of curvature less than ~50–70 times thickness. Above ~1.7 wt% boron (the upper limit of boron concentration in the alloys of the present invention) the alloys continue to exhibit excellent ribbon fabricability. However, these alloys can be quenched into a single supersaturated solid solution phase. The excess boron forms eutectic borides around the primary grains. Further, the alloys are too rich in boride content and become brittle after heat treatment. While all of the as-quenched metastable single phase crystalline alloys containing 0.4 to 1.7 wt% B were found to be brittle, subsequent heat treatments which causes a phase transformation can be used to transform the alloys to a ductile, tough state having very desirable mechanical properties, i.e., high tensile strength and high hardness. The alloys with boron content between 0.6 to 1.25 wt% are preferred because of the good mechanical properties which can be achieved after heat treatment.

During consolidation, precipitates of borides throughout the grains and the grain boundaries stabilize the ultrafine grain structure (1–2 micron diameter) obtained by RSP. Ultrafine grained powders can be fully consolidated by superplastic deformation at relatively low temperature (i.e., ~1800° F.) thereby preventing formation of deleterious carbides at the powder particle surfaces. Formation of such surface carbides at the high temperature (>2000° F.) normally used to consolidate superalloy powder is undesirable on both a micro and a macro scale. On a microscale, there will then be insufficient grain boundary carbides in the particle's interior and, on a larger scale, the alignment of the coarse particle-surface carbides in the direction of working has the same adverse effect as any other non-metallic inclusion on the properties of a wrought alloy (see G. I. Friedman and G. S. Ansell in *The Superalloys*, G. T. Sims and W. C. Hagel, Eds., John Wiley and Sons, New York, 1972, p.427).

Furthermore, since the hard refractory borides are insoluble in the nickel base matrix, thermal stability and hence creep strength of the alloys will be enhanced at high temperatures. High hardness, high thermal stability, a uniform fine grained microstructure and a fine dispersion of borides, carbides and the intermetallic $\gamma'$ make the present modified nickel base superalloys especially suitable for applications such as gas turbine disks and the like up to temperatures of at least 1400° F.

A generalized composition of the modified superalloys of the present invention is given as follows: (subscripts in wt%) $[Ni_{bal}Cr_{6-20}Ti_{0-6}Al_{1-8}Cb_{0-4}Ta_{0-10}Mo_{0-13}W_{0-13}Co_{0-25}Fe_{0-20}C_{0.04-0.35}(Hf,V,Zr,Mn,Si,Mg)_{0-4}]_{98.3-99.6}B_{0.4-1.7}$ where the formula in the large parenthesis is a generalized formula for commercially marketed, precipitation-hardened, nickel base superalloys in which the nickel is present at a level of more than 50 wt%. Of special interest are the superalloys such as Astroloy, B1900, Waspaloy, Rene 95, Rene 80, Udimet 700, Inconel 718 and MAR-M200 which are modified to contain 0.4 to 1.7 wt% B and fabricated as RSP powders in accordance with the present invention.

The addition of B to selected precipitation-hardened, iron-nickel base superalloys and their subsequent RSP treatment, similar to that described above for the nickel base superalloys, leads to similar benefits. For such alloys, the above formula is modified to contain 20 to 65 wt% Fe, the increased Fe content being achieved by lowering the Ni content to between 5 to 50 wt%.

EXAMPLES 1-16

A number of commercial nickel base superalloys such as Udimet 700, Waspaloy, Astroloy, B-1900, IN-100, MAR-M200 and Rene 80 were alloyed with 0.4 to 1.7 wt% boron in accordance with the present invention (see Table 1-an alloy designaed as Waspaloy +0.4B means commercial Waspaloy modified by the addition of 0.4 wt% boron and so forth). The alloys were fabricated as ribbons having thicknesses of ~0.0015-0.0020 inches by the RSP method of melt spinning using a rotating Cu-Be cylinder having a quench surface speed of ~5000 ft/min. The ribbons were found by x-ray diffraction analysis to consist predominantly of a single solid solution phase with a f.c.c. crystal structure. Ductility of a ribbon was measured by the bend test. The ribbon was bent to form a loop and the diameter of the loop was gradually reduced until the loop is fractured. The breaking diameter of the loop is a measure of ductility. The larger the breaking diameter for a given ribbon thickness, the more brittle the ribbon is considered to be, i.e., the less ductile. The as-quenched ribbons were all found to have breaking diameters of ~0.1 inch and thus are quite brittle. The ribbons were heat treated at 1900° F. for 3 hours and then air cooled to room temperature. The ribbons were found to be fully ductile, i.e., to bend back onto themselves so as to plastically deform into a U shape without breaking, and have high hardness as measured by a Microhardness tester. The results are given in Table 1. The heat treatment (1900° F., 3 hours) corresponds approximately to a time temperature cycle which might be used for a hot consolidation operation. At 1900° F., the alloys contain primarily a fine dispersion of boride particles (less than 0.5 microns) in the $\gamma$ matrix. During cooling $\gamma'$ precipitates as fine particles in the matrix.

EXAMPLES 17-18

Two commercial iron-nickel base superalloys A-286 and Unitemp-212 (see Table 2 below for compositions) are alloyed with 0.9 wt% boron in accordance with the present invention and fabricated as ribbons having thicknesses of ~0.0015 inches by the RSP method of melt spinning on a rotating chill Cu-Be substrate. The ribbons are found by X-ray diffraction analysis to consist predominantly of a single solid solution phase with a f.c.c. crystal structure. The as-quenched ribbons are found to be brittle by the bend test. The ribbons upon heat treatment at 1900° F. for 3 hours followed by air cooling to room temperature are found to be fully ductile to 180° bending.

TABLE 2

| Alloy | Fe | Ni | Cr | Mo | Cb | Ti | Al | B | Zr | C | Mn | Si |
|---|---|---|---|---|---|---|---|---|---|---|---|---|
| A-286 | Bal | 26 | 15 | 1.25 | — | 2.15 | 0.2 | .003 | — | .05 | 1.4 | .4 |
| Unitemp 212 | Bal | 25 | 16 | — | 0.5 | 4.0 | 0.15 | .06 | .05 | .08 | .05 | .15 |

EXAMPLES 19-21

Three nickel base superalloys containing higher amounts of $\gamma'$ forming elements than presently available commercial alloys (compositions listed in Table 3 below) are alloyed with 0.9 wt% boron in accordance with the present invention and fabricated as ribbons (~0.0015 inches thick). The ribbons, which are found to consist predominantly of a single solid solution phase with a f.c.c. crystal structure, are found to be very brittle, i.e., fracture when bent to a radius of curvature less than ~0.050". The ribbons upon heat treatment (1900° F. for 3 hours followed by air cooling to room temperature) are found to be fully ductile to 180° bending.

TABLE 3

| | Chemical composition (wt %) | | | | | | | | | | | |
|---|---|---|---|---|---|---|---|---|---|---|---|---|
| Ex.# | Ni | Co | Cr | Al | Ti | C | B | Mo | W | Zr | Nb | Ta |
| 19 | Bal | 10 | 10 | 9.0 | 1.5 | 0.15 | .005 | 3 | — | .006 | — | — |
| 20 | Bal | — | 9 | 8.5 | 1.5 | 0.05 | .005 | — | 12 | .005 | 1.0 | — |
| 21 | Bal | — | — | 9.5 | — | — | — | 12 | — | — | — | 1.0 |

EXAMPLE 22

A commercial nickel base superalloy, Udimet 700, was modified to contain 0.8 wt% boron. The alloy was melt spun into a ribbon shape. The ribbons, which were found to be brittle, were pulverized by a commercial Bantam Mikro Pulverizer into powder. The powder was screened through a 100 mesh (U.S. Standard) sieve and gave a high yield of the under 100 mesh powder.

TABLE 1

Bend ductility and hardness values of ribbons of alloys of the present invention as formed by the RSP process (melt-spinning) and after being heat treated.

| Example | Alloy | Composition (wt %) | | | | | | | | | | | | | | |
|---|---|---|---|---|---|---|---|---|---|---|---|---|---|---|---|---|
| | | Ni | Cr. | Co. | Mo | W | Cb | Ta | Fe | Ti | Al | C | Zr | B | Mn | Si |
| 1 | Udimet 700 + 0.4B | Bal | 14.94 | 18.43 | 4.98 | — | — | — | 0.5 | 3.49 | 4.39 | .07 | — | 0.4 | — | — |
| 2 | Udimet 700 + 0.8B | Bal. | 14.88 | 18.35 | 4.96 | — | — | — | 0.5 | 3.74 | 4.37 | 0.07 | — | 0.8 | — | — |
| 3 | Waspaloy + 0.8B | Bal | 19.34 | 13.39 | 4.27 | — | — | — | 1.98 | 2.98 | 1.39 | .069 | .09 | 0.8 | 0.5 | 0.5 |
| 4 | B1900 + 0.8B | Bal | 7.94 | 9.92 | 5.95 | 0.1 | 0.1 | — | — | 0.99 | 5.95 | 0.1 | .08 | 0.8 | 0.2 | 0.25 |
| 5 | IN-100 + 0.8B | Bal | 9.92 | 14.88 | 2.98 | — | — | — | — | 4.66 | 5.46 | 0.18 | .06 | 0.8 | — | — |
| 6 | Rene 80 + 0.4B | Bal | 13.94 | 9.46 | 3.98 | 3.98 | — | — | 1 | 4.98 | 2.99 | .17 | .03 | 0.4 | — | — |
| 7 | Udimet 700 + 1.2B | Bal | 14.82 | 18.28 | 4.94 | — | — | — | 0.5 | 3.46 | 4.35 | .07 | — | 1.2 | — | — |
| 8 | B1900 + 1.7B | Bal | 7.86 | 9.0 | 5.9 | 0.1 | — | — | — | 0.98 | 5.9 | 0.1 | .08 | 1.7 | — | — |
| 9 | Inconel 718 + 1.5B | Bal | 18.72 | — | 2.96 | — | 4.93 | — | 18.22 | 0.89 | 0.49 | .04 | — | 1.5 | — | — |
| 10 | Astroloy + 1.0B | Bal | 14.85 | 14.85 | 5.2 | — | — | — | — | 3.47 | 4.36 | .06 | — | 1.0 | | |
| 11 | Mar-M200 + 0.8B | Bal | 8.93 | 9.92 | — | 12.4 | 1.79 | — | — | 1.98 | 4.96 | 0.15 | .05 | 0.8 | — | — |
| 12 | Mar-M200 + 1.2B | Bal | 8.89 | 9.88 | — | 12.35 | 1.78 | — | — | 1.98 | 4.94 | 0.15 | .05 | 0.8 | — | — |
| 13 | B 1900 + 0.4B | Bal | 7.97 | 9.96 | 5.98 | 0.1 | 0.1 | — | — | 1.0 | 5.98 | 0.1 | .08 | 0.4 | 0.2 | 0.25 |
| 14 | B 1900 + 0.6B | Bal | 7.95 | 9.94 | 5.96 | 0.1 | 0.1 | — | — | 1.0 | 5.96 | 0.1 | .08 | 0.6 | 0.2 | .25 |
| 15 | Waspaloy + 1.4B | Bal | 19.23 | 13.31 | 4.24 | — | — | — | 1.97 | 2.96 | 1.38 | .07 | .09 | 1.4 | 0.5 | 0.5 |
| 16 | Astroloy + 1.65B | Bal | 14.75 | 14.75 | 5.16 | — | — | — | — | 3.44 | 4.33 | .06 | — | 1.65 | — | — |

| | | | RSP Ribbon | RSP Ribbon after Heat treatment at 1900° F. for 3 hours and air cooling | |
|---|---|---|---|---|---|
| Example | Alloy | Other | Bend Ductility as Measured by the Breaking Diameter (inch) | Bend Ductility as measured by the Breaking Diameter (inch) | Hardness (VHN) |
| 1 | Udimet 700 + 0.4B | — | 0.099 | <.003 | 630 |
| 2 | Udimet 700 + 0.8B | — | 0.128 | <.003 | 475 |
| 3 | Waspolpy + 0.8B | — | 0.120 | <.004 | 666 |
| 4 | B1900 + 0.8B | — | 0.105 | <.004 | 645 |
| 5 | IN-100 + 0.8B | .99V | 0.096 | <.003 | 718 |
| 6 | Rene 80 + 0.4B | — | .078 | <.003 | 698 |
| 7 | Udimet 700 + 1.2B | — | .097 | <.004 | 520 |
| 8 | B1900 + 1.7B | — | 0.133 | <.004 | 483 |
| 9 | Inconel 718 + 1.5B | 0.2Cu | 0.128 | <.003 | 502 |
| 10 | Astroloy + 1.0B | | 0.112 | <.003 | 655 |
| 11 | Mar-M200 + 0.8B | — | 0.085 | <.004 | 650 |
| 12 | Mar-M200 + 1.2B | — | 0.118 | <.004 | 499 |
| 13 | B 1900+ 0.4B | — | 0.080 | <.003 | 685 |
| 14 | B 1900 + 0.6B | | 0.096 | <.003 | 710 |
| 15 | Waspaloy + 1.4B | | 0.115 | <.004 | 528 |
| 16 | Astroloy + 1.65B | | 0.122 | <.004 | 488 |

EXAMPLE 23

The following example illustrates production of consolidated alloys of the present invention. RSP powders of Udimet 700 modified with 0.8 wt% boron having a particle size under 100 mesh are packed and sealed off under vacuum in a mild steel cylindrical container. The container is hot isostatically pressed at 1900° F. and 15,000 psi for 3 hours into a fully dense ingot.

EXAMPLE 24

The following example illustrates an economical method of continuous production of RSP powder of the boron modified nickel base superalloys in accordance with the present invention.

The commercial nickel base superalloys containing 0.4 to 1.7 wt% are melted by vacuum induction melting. The melt is transferred via a ladle into a tundish having a series of orifices. A multiple number of jets are allowed to impinge on a rotating water-cooled copper-beryllium drum whereby the melt is rapidly solidified as ribbon. The as-cast brittle ribbons are fed into a hammer mill whereby the ribbons are ground into powders of desirable size ranges. The entire operation as described above is carried out under high vacuum or a protective atmosphere to prevent oxidation.

We claim:

1. A nickel base alloy obtained by adding 0.4 to 1.7 wt% boron to an alloy having a composition represented by $Ni_{Balance}M_aM'_bT_c$, where M is at least one element selected from the group consisting of titanium, aluminum, columbium, and tantalum and mixtures thereof, M' is at least one element selected from the group consisting of chromium, cobalt, iron, tungsten and molybdenum and mixtures thereof, and T is at least one element selected from the group consisting of carbon, hafnium, zirconium, vanadium, manganese, silicon and magnesium and mixtures thereof, and where a, b and c are atomic percentages ranging from 7 to 20, 8 to 43 and 0.1 to 4, respectively, where the sum of a, b and c is less than 50, where the molybdenum and tungsten content combined is in the range of 0 to 15 at %, said alloy being prepared from the melt thereof by a rapid solidification process characterized by cooling rates in the range of about $10^5$ and $10^7$ °C./sec. said alloy consisting of an ultra fine grain structure having an average grain size of less than about 2 microns comprised predominately of a nickel rich solid solution phase having a face-centered cubic crystalline structure, said alloy having very low bend ductility.

2. A nickel base alloy according to claim 1 wherein said alloy is in sheet form.

3. A nickel base alloy according to claim 1 wherein said alloy is in filament form.

4. A nickel base alloy according to claim 1 wherein said alloy is in powder form.

5. A nickel base alloy having the composition represented by the formula $[Ni_{Balance}Cr_{6-20}Ti_{0-6}Al_{1-8}Cb_{0-4}Ta_{0-10}Mo_{0-13}W_{0-13}Co_{0-25}Fe_{0-20}C_{0.04-0.35}(Hf, Zr, V, Mn, Si, Mg)_{0-4}]_{98.3-99.6}B_{0.4-1.7}$, where the subscripts define weight percent and where the nickel is present at a level of more than 50 wt%, said alloy being prepared from the melt thereof by a rapid solidification process characterized by cooling rates on the order of about $10^5$ to $10^7$ °C./sec, said alloy consisting of an ultrafine grain structure having an average grain size of less than about 2 microns comprised predominately of a nickel rich solid solution phase having a face-centered cubic crystalline structure, said alloy having very low bend ductility.

6. A nickel base alloy according to claim 5 wherein the boron content is between 0.8 to 1.25 wt%.

7. A nickel base alloy according to claim 5 wherein said alloy is in sheet form.

8. A nickel base alloy according to claim 5 wherein said alloy is in filament form.

9. A nickel base alloy according to claim 5 wherein said alloy is in powder form.

10. An iron-nickel base alloy obtained by adding 0.4–1.7 wt% boron to an alloy having a composition represented by $Fe_xNi_yM_aM''_bT_c$ where M is at least one element selected from the group consisting of titanium, aluminum, columbium, and tantalum and mixtures thereof, M'' is at least one element selected from the group consisting of chromium, cobalt, tungsten and molybdenum and mixtures thereof, and T is at least one element selected from the group consisting of carbon, hafnium, zirconium, vanadium, manganese, silicon and magnesium and mixtures thereof, where x, y, a, b and c are atomic percentages ranging from 20 to 65, 5 to 50, 7 to 20, 8 to 43 and 0.1 to 4, respectively, and where the sum of a, b and c is less than 50 and the molybdenum and tungsten content combined is in the range of 0 to 15 at%, said alloy being prepared from the melt thereof by a rapid solidification process characterized by cooling rates in the range of about $10^5$ to $10^7$ °C/sec. said alloy consisting of an ultrafine grain structure having an average grain size of less than about 2 microns comprised predominately of a solid solution phase having very low bend ductility.

11. An iron-nickel base alloy according to claim 10 wherein said alloy is in sheet form.

12. An iron-nickel base alloy according to claim 10 wherein said alloy is in filament form.

13. An iron-nickel base alloy according to claim 10 wherein said alloy is in powder form.

14. An iron-nickel base alloy having the composition represented by the formula $98.3–99.6\ B_{0.4–1.7}$ where the subscripts define weight percent and where the iron and nickel taken together comprise more than 50 wt% and where said alloy is characterized by a structure comprised of an iron-nickel rich matrix containing ultrafine borides having an average particle size of less than about 0.3 micron.

15. The method of preparing a rapidly solidified alloy of claim 7 in powder form, comprising the steps of (a) making a melt of said alloy, (b) contacting said melt against a rapidly moving chill substrate to solidify said melt into one of the group consisting of sheet, filament and ribbon form, and, (c) mechanically comminuting said one of the group consisting of sheet, filament and ribbon into powder.

16. A nickel base alloy having the composition represented by the formula $98.3–99.6^B0.4–1.7$, where the subscripts define weight percent and where the nickel is present at a level of more than 50 wt%, said alloy being characterized by a structure comprised of a nickel rich matrix containing ultrafine borides having an average particle size of less than about 0.3 micron and a fine dispersion of an intermetallic $Ni_3$ (Ti, Al) base compound.

17. A nickel base alloy obtained by adding 0.4 to 1.7 wt% boron to an alloy having a composition represented by $Ni_{Balance}\ M_aM'_bT_c$, where M is at least one element selected from the group consisting of titanium, aluminum, columbium, and tantalum and mixtures thereof, M' is at least one element selected from the group consisting of chromium, cobalt, iron, tungsten and molybdenum and mixtures thereof, and T is at least one element selected from the group consisting of carbon, hafnium, zirconium vanadium, manganese, silicon and magnesium and mixtures thereof, and where a, b and c are atomic percentages ranging from 7 to 20, 8 to 43 and 0.1 to 4, respectively, where the sum of a, b and c is less than 50, where the molybdenum and tungsten content combined is in the range of 0 to 15 at %, said alloy being characterized by a structure comprised of a nickel rich matrix containing ultrafine borides having an average particle size of less than about 0.3 micron and a fine dispersion of an intermetallic $Ni_3$ (Ti, Al) base compound.

18. The method of preparing a rapidly solidified alloy of claim 10 in powder form, comprising the steps of (a) making a melt of said alloy, (b) contacting said melt against a rapidly moving chill substrate to solidify said melt into one of the group consisting of sheet, filament and ribbon form, and, (c) mechanically comminuting said one of the group consisting of sheet, filament and ribbon form into powder.

19. A nickel base alloy according to claim 16 wherein said alloy is in the form of a bulk part.

20. A nickel base alloy according to claim 17 wherein said alloy is in the form of a finished article of manufacture.

21. A nickel base alloy according to claim 17 in the form of a body having a minimum thickness of 1 mm measured in the shortest direction.

22. A nickel base alloy according to claim 16 wherein said boride particles are present in said alloy in the form of a dispersion inside the grains and along the grain boundaries.

* * * * *